US006099714A

United States Patent [19]

Bibber

[11] Patent Number: 6,099,714

[45] Date of Patent: Aug. 8, 2000

[54] PASSIFICATION OF TIN SURFACES

[75] Inventor: John W. Bibber, Batavia, Ill.

[73] Assignee: Sanchem, Inc., Chicago, Ill.

[21] Appl. No.: 09/029,351

[22] PCT Filed: Aug. 30, 1996

[86] PCT No.: PCT/US96/13859

§ 371 Date: Feb. 24, 1998

§ 102(e) Date: Feb. 24, 1998

[87] PCT Pub. No.: WO97/08364

PCT Pub. Date: Mar. 6, 1997

[51] Int. Cl.[7] ..... C25D 3/06

[52] U.S. Cl. ..... 205/287; 205/243

[58] Field of Search ..... 205/287, 243, 205/215, 289, 290; 148/267

[56] References Cited

U.S. PATENT DOCUMENTS

| | | | |
|---|---|---|---|
| 3,313,714 | 4/1967 | Joyce et al. . | |
| 3,616,303 | 10/1971 | Carter . | |
| 3,798,074 | 3/1974 | Esler et al. . | |
| 3,932,198 | 1/1976 | Schneider . | |
| 4,123,290 | 10/1978 | Kennedy . | |
| 4,169,022 | 9/1979 | Ward et al. . | |
| 4,293,620 | 10/1981 | Vigar . | |
| 4,388,158 | 6/1983 | Inui et al. . | |
| 4,507,178 | 3/1985 | Barclay . | |
| 4,690,735 | 9/1987 | Laitinen et al. . | |
| 4,875,983 | 10/1989 | Alota et al. . | |
| 5,091,023 | 2/1992 | Saeki et al. . | |
| 5,188,905 | 2/1993 | Shindou et al. . | |
| 5,283,131 | 2/1994 | Mori et al. | 428/623 |
| 5,294,266 | 3/1994 | Hauffe et al. . | |
| 5,354,458 | 10/1994 | Wang et al. . | |
| 5,378,291 | 1/1995 | Ara et al. . | |
| 5,389,405 | 2/1995 | Purnell et al. . | |
| 5,393,354 | 2/1995 | Bishop . | |
| 5,415,763 | 5/1995 | Johnson et al. . | |
| 5,560,815 | 10/1996 | Sekimoto et al. | 205/284 |

OTHER PUBLICATIONS

Process technology for the production of highly passivated tinplate by Jargon, F.; Maschke, E. 1975. No month available.

*Primary Examiner*—Kathryn Gorgos
*Assistant Examiner*—Wesley A. Nicolas
*Attorney, Agent, or Firm*—Robert F. I. Conte Lee, Mann, Smith, McWilliams, Sweeney, & Ohlson

[57] ABSTRACT

The present invention provides a method of coating a tin article with a non-hexavelant trivcalent chromium oxide and/or hydoxide in which the tin article is contacted with a trivalent chromium protective coating composition having an acid pH of about 2.0 to 3.0 which is free of chromium complexing agents.

9 Claims, No Drawings

PASSIFICATION OF TIN SURFACES

This application claims the benefit of International Application PCT/US96/13859, with an International filing date of Aug. 20, 1996. This application is also a continuation of U.S. patent application Ser. No. 08/521,832 filed Aug. 31, 1995, still pending.

FIELD OF INVENTION

The invention relates to a tin coating composition and a method of providing tin with a protective coating. More particularly, the present invention provides a tin coating composition having as its essential ingredient chromium in the trivalent state (chromium III), and a method of coating the tin using a trivalent chromium composition having a pH of about 2 to about 3.

BACKGROUND OF INVENTION

The thin natural oxide film which forms on tin surfaces provides a useful protective barrier and improves paint adhesion. If uncontrolled, however, the thin oxide film will form a thick yellow non-protective and non-adhesive layer. Therefore, a goal of tin producers has been to provide tin with an oxide film while preventing its rapid uncontrolled growth to a thick layer which prevents the effective adhesion of paint to the tin surface. Tin producers have passified tin surfaces in various ways to provide tin with a thin oxide film while preventing its rapid uncontrolled growth. In addition, proper passification of tin surfaces prevents or substantially reduces sulfide stains.

Previous attempts at passification have mainly centered around thickening the natural oxide film with an oxidant while leaving a corrosion resistant film on the surface of the metal to retard further oxide growth and prevent sulfide stains. U.S. Pat. No. 1,827,204, discloses an electrolytic process which uses chromates to both thicken the oxide film and leave a film of reduced chromic oxides to prevent further oxide growth and prevent sulfide stains. French Patent 777,314, Tichauer, discloses a process which used sodium molybdates as an oxidant and various heavy metals to provide a passive film on the surface of the metal. U.S. Pat. No. 2,024,951 discloses a process which uses potassium permanganate to both stabilize the oxide film and reduce sulfide staining. In 1940, U.S. Pat. No. 2,215,165, disclosed an electrolytic process which oxidized and then reduced the tin surface to thicken the oxide film and leave a passive tin surface. That same year Ken R., *Protective Films on Tin Plate by Chemical Treatment*, J. Sol. Chem. Ind., 59, 259 C 1940, disclosed the results of an investigation which showed that an alkaline solution of chromates would passivate tin surfaces. In 1943, U.S. Pat. No. 2,312,076, disclosed a process which used dichromates mixed with phosphates to passivate tin surfaces. Since that time new patents, i.e., U.S. Pat. No. 2,606,866, have been issued, but have all centered around improvements in the basic dichromate/chromic acid processes mentioned.

A major drawback of the prior arts chromium containing coating compositions is their reliance on hexavalent chromium. Hexavalent chromium is extremely toxic and thus more costly to work with. For instance, hexavalent chromium requires special waste disposal.

SUMMARY OF INVENTION

It is an object of the present invention to provide a method for coating tin or tin plated articles with a non-hexavalent chromium protecting coating comprising coating said tin or tin plated article with a hexavalent chromium free trivalent chromium composition having a pH of about 2.0 to about 3.0.

It is a further object of the invention to provide a passified tin or tin plated article having coated thereon a trivalent chromium protective coating.

Accordingly, one aspect of the invention is directed toward providing a method of coating an article of tin or tin plated material with a protective coating. The process provides an electrolyte composition having an acid pH of about is 2 to about 3 and as its essential ingredient, chromium in the trivalent state. The process contacts the article with the electrolyte composition and deposits trivalent chromium on the article by electrolysis.

Another aspect of the invention is directed at a trivalent chromium coating composition for coating tin.

Still another aspect of the invention is directed at a manufacture of an article of tin or tin coated material having a trivalent chromium protective coating thereon.

DETAILED DESCRIPTION

The present invention can be further understood with reference to the following description and examples.

The present invention eliminates the need for hexavalent chromium compositions which, due to their extreme toxicity, are being forced out of the work place environment. In addition, the invention provides substantially the same high level of corrosion resistance and sulfide stain resistance as that given by hexavalent chromium compositions while at the same time being considerably less toxic. Very little toxic waste is produced and thus very little needs to be disposed of.

Accordingly, this invention provides a protective coating for tin and tin plated surfaces which has as its essential ingredient trivalent chromium (Chromium (III)). The process uses electrolysis of various trivalent chromium solutions to deposit a thin film of various reduced chromic oxides or hydroxides. The concentration of chromium (III) in solution and the amount of current applied determines the amounts of chromic oxide, $Cr_2O_3$, trivalent chromium hydroxide and chromium deposited and the time needed to deposit them. A concentration of chromium (III) below 0.05 grams/liter is not economically feasible to deposit because the corrosion resistant film has insufficient thickness. The upper concentration limit is the saturation point of the chromium (III) salt in question. To provide a strong thin coating, a pH range of about 2.0 to about 3.0 is used. A high pH produces a film with an undesirable gray color and reduced corrosion resistance. Below pH 2.0 the chromium oxides and/or hydroxides are dissolved off the metal surface as fast as they are formed. The most preferred pH is 2.25 to 2.40. The pH, when necessary, is adjusted and maintained adding an appropriate buffer. As seen in example 3, infra, a pH of 1.9 shows a marked increase in yellowing oxide formation which is not desirable. The prior art simply does not recognize the criticality of applicant's pH range. In fact U.S. Pat. No. 4,875,983, indicates a preferable pH between 0.5 and 1.5.

The voltage should preferably be above the reduction potential of chromium (III). In water this is about 0.74 volts relative to the standard hydrogen electrode.

The preferred chromium (III) salts are the chloride and the sulfate. Other chromium (III) salts have anions which inhibit production of a passive film on tin surfaces. The sulfate is the most preferred because the chloride may release chlorine gas at the anode of the electrolytic cell and cause environmental problems. In addition, the sulfate is generally less expensive.

Potassium chromium sulfate is the most preferred sulfate as simple chromium sulfate is not as conductive and is less soluble. Various other materials may be added to the bath to increase conductivity, prevent formation of hexavalent chromium and to clean or wet out the surface of the tin as long as these materials do not inhibit film formation or destroy film quality. Although not desirable from an environmental point of view the presence of hexavalent chromium will not be harmful to the bath.

My composition and process preferably does not contain any complexing agents or agents which interfere with the depositing of trivalent chromium oxide on tin. Some examples of such agents are aminosulfuric acid, ammonium ions, formic acid, hypophosphite, glycine, gluconolactone, glycollic acid, glycollic acetate and glycollic formate.

The following examples 1–21 illustrate the invention in detail. The tin plated steel surface or pure tin of the examples was cleaned of oils and/or loose soil with a non-ionic detergent. Then the cleaned tin plated steel or tin sheet is made the cathode of an electrolytic cell of 12 volts and 10 amps for 30 seconds in a dilute sodium carbonate solution (2.5 grams per liter) to obtain a clean reactive surface. The clean surface was then rinsed in D.I. water and treated as indicted immediately. The tin plated steel and tin of the examples were 3 inches by 5 inch metal strips. The applied voltage was 12 volts and the applied amperage was 10 or 2 amps. Exposure time was two to five seconds. Examples 1 through 3 show the unacceptable results of using a pH outside of the desired range.

EXAMPLE 1

A solution of 5.0 g/l potassium chromium sulfate twelve hydrate ($KCr(SO_4)_2 \cdot 12H_2O$) which contains about 0.52 grams of chromium (0.052%) was used as the electrolyte for an electrolytic cell in which tin plate was the cathode and stainless steel the anode. Twelve volts and ten amps were applied to the solution for five seconds at 70° F. and a pH of 3.5. The light gray colored tin plate was rinsed in D.I. water, dried, and placed in a boiling solution of 6.67 g/l sodium thiosulfate five hydrate, 1.67 g/l sulfuric acid and 1.0 g/l non-ionic wetting agent for two minutes. The exposed tin surface showed slight sulfide staining. Baking the rest of the exposed tin surface at 420° F. for one hour showed slight yellow stains due to tin oxide formation.

EXAMPLE 2

A solution of 5.0 g/l potassium chromium sulfate twelve hydrate ($KCr(SO_4)_2 \cdot 12H_2O$) which contains about 0.52 grams of chromium (0.052%) was used as the electrolyte for an electrolytic cell in which tin plate was the cathode and stainless steel the anode. Twelve volts and ten amps were applied to the solution for five seconds at 70° F. and a pH of 3.25. The very light gray colored tin plate was rinsed in D.I. water, dried, and placed in a boiling solution of 6.67 g/l sodium thiosulfate five hydrate, 1.67 g/l sulfuric acid and 1.0 g/l non-ionic wetting agent for two minutes. The exposed tin surface showed slight sulfide staining. Baking the rest of the exposed tin surface at 420° F. for one hour showed very light yellow stains due to tin oxide formation.

EXAMPLE 3

A solution of 5.0 g/l potassium chromium sulfate twelve hydrate ($KCr(SO_4)_2 \cdot 12H_2O$) which contains about 0.52 grams of chromium (0.052%) was used as the electrolyte for an electrolytic cell in which tin plate was the cathode and stainless steel the anode. Twelve volts and ten amps were applied to the solution for five seconds at 70° F. and a pH of 1.9. The silvery colored tin plate was rinsed in D.I. water, dried, and placed in a boiling solution of 6.67 g/l sodium thiosulfate five hydrate, 1.67 g/l sulfuric acid and 1.0 g/l non-ionic wetting agent for two minutes. The exposed tin surface showed sulfide staining. Baking the rest of the exposed tin surface at 420° F. for one hour showed yellow stains due to tin oxide formation.

EXAMPLE 4

A solution of 5.0 g/l potassium chromium sulfate twelve hydrate ($KCr(SO_4)_2 \cdot 12H_2O$) which contains about 0.52 grams of chromium (0.052%) was used as the electrolyte for an electrolytic cell in which tin plated steel sheet was the cathode and stainless steel the anode. Twelve volts and ten amps were applied to the solution for five seconds at 70° F. and a pH of 2.3. The tin plated steel was rinsed in D.I. water, dried, and placed in a boiling solution of 6.67 g/l sodium thiosulfate five hydrate, 1.67 g/l sulfuric acid and 1.0 g/l non-ionic wetting agent for two minutes. The exposed tin surface showed no sulfide staining. Baking the rest of the exposed tin surface at 420° F. for one hour showed no yellowing due to tin oxide formation.

EXAMPLE 5

A solution of 5.0 g/l potassium chromium sulfate twelve hydrate ($KCr\ (SO_4)_2 \cdot 12H_2O$) which contains about 0.52 grams of chromium (0.052%) was used as the electrolyte for an electrolytic cell in which tin was the cathode and stainless steel the anode. Twelve volts and ten amps were applied to the solution for five seconds at 70° F. and a pH of 2.3. The tin was rinsed in D.I. water, dried, and placed in a boiling solution of 6.67 g/l sodium thiosulfate five hydrate, 1.67 g/l sulfuric acid and 1.0 g/l non-ionic wetting agent for two minutes. The exposed tin surface showed no sulfide staining. Baking the rest of the exposed tin surface at 420° F. for one hour showed no yellowing due to tin oxide formation.

EXAMPLE 6

A solution of 4.0 g/l potassium chromium sulfate twelve hydrate ($KCr(SO_4)_2 \cdot 12H_2O$) which contains about 0.42 grams of chromium (0.042%) was used as the electrolyte for an electrolytic cell in which tin plate was the cathode and stainless steel the anode. Twelve volts and ten amps were applied to the solution for five seconds at 70° F. and a pH of 2.3. The tin plate was rinsed in D.I. water, dried, and placed in a boiling solution of 6.67 g/l sodium thiosulfate five hydrate, 1.67 g/l sulfuric acid and 1.0 g/l non-ionic wetting agent for two minutes. The exposed tin surface showed slight sulfide staining. Baking the rest of the exposed tin surface at 420° F. for one hour showed slight yellowing due to tin oxide formation.

EXAMPLE 7

A saturated solution of potassium chromium sulfate twelve hydrate ($KCr(SO_4)_2 \cdot 12H_2O$) was used as the electrolyte for an electrolytic cell in which tin plate as the cathode and stainless steel the anode. Twelve volts and two amps were applied to the solution for two seconds at 70° F. and a pH of 2.3. The tin plate was rinsed in D.I. water, dried, and placed in a boiling solution of 6.67 g/l sodium thiosulfate five hydrate, 1.67 g/l sulfuric acid and 1.0 g/l non-ionic wetting agent for two minutes. The exposed tin surface showed no sulfide staining. Baking the rest of the exposed tin surface at 420° F. for one hour showed no yellowing due to tin oxide formation.

EXAMPLE 8

A saturated solution of potassium chromium sulfate twelve hydrate ($KCr(SO_4)_2 \cdot 12H_2O$) was used as the electrolyte for an electrolytic cell in which tin plate was the cathode and stainless steel the anode. Twelve volts and two amps were applied to the solution for two seconds at 200° F. and a pH of 2.3. The tin plate as rinsed in D.I. water, dried, and placed in a boiling solution of 6.67 g/l sodium thiosulfate five hydrate, 1.67 g/l sulfuric acid and 1/0 g/l non-ionic wetting agent for two minutes. The exposed tin surface showed no sulfide staining. Baking the rest of the exposed tin surface at 420° F. for one hour showed no yellowing due to tin oxide formation.

EXAMPLE 9

A saturated solution of potassium chromium sulfate twelve hydrate ($KCr(SO_4)_2 \cdot 12H_2O$) was used as the electrolyte for an electrolytic cell in which tin plate was the cathode and stainless steel the anode. Twelve volts and two amps were applied to the solution for two seconds at 30° F. and a pH of 2.3. The tin plate was rinsed in D.I. water, dried, and placed in a boiling solution of 6.67 g/l sodium thiosulfate five hydrate, 1.67 g/l sulfuric acid and 1.0 g/l non-ionic wetting agent for two minutes. The exposed tin surface showed no sulfide staining. Baking the rest of the exposed tin surface at 420° F. for one hour showed no yellowing due to tin oxide formation.

EXAMPLE 10

A solution of 5.0 g/l chromium (III) chloride hexahydrate was used as the electrolyte for an electrolytic cell in which tin plate was the cathode and stainless steel the anode. Twelve volts and ten amps were applied to the solution for two seconds at 70° F. and a pH of 2.3. The tin plate was rinsed in D.I. water, dried, and placed in a boiling solution of 6.67 g/l sodium thiosulfate five hydrate, 1.67 g/l sulfuric acid and 1.0 g/l non-ionic wetting agent for two minutes. The exposed tin surface showed no sulfide staining. Baking the rest of the exposed tin surface at 420° F. for one hour showed no yellowing due to tin oxide formation.

EXAMPLE 11

A solution of 5.0 g/l chromium (III) sulfate hydrate was used as the electrolyte for an electrolytic cell in which tin plate was the cathode and stainless steel the anode. Twelve volts and ten amps were applied to the solution for two seconds at 70° F. and a pH of 2.3. The tin plate was rinsed in D.I. water, dried, and placed in a boiling solution of 6.67 g/l sodium thiosulfate five hydrate, 1.67 g/l sulfuric acid and 1.0 g/l non-ionic wetting agent for two minutes. The exposed tin surface showed no sulfide staining. Baking the rest of the exposed tin surface at 420° F. for one hour showed no yellowing due to tin oxide formation.

EXAMPLE 12

A solution of 5.0 g/l potassium chromium sulfate twelve hydrate ($KCr(SO_4)_2 \cdot 12H_2O$) which contains about 0.52 grams of chromium (0.052%) was used as the electrolyte for an electrolytic cell in which tin plate was the cathode and stainless steel the anode. Twelve volts and ten amps were applied to the solution for five seconds at 70° F. and a pH of 3.0. The silvery colored tin plate was rinsed in D.I. water, dried, and placed in a boiling solution of 6.67 g/l sodium thiosulfate five hydrate, 1.67 g/l sulfuric acid and 1.0 g/l non-ionic wetting agent for two minutes. The exposed tin surface showed no sulfide staining. Baking the rest of the exposed tin surface at 420° F. for one hour showed no yellow stains due to tin oxide formation.

EXAMPLE 13

A solution of 5.0 g/l potassium chromium sulfate twelve hydrate ($KCr(SC_4)_2 \cdot 12H_2O$) which contains about 0.52 grams of chromium (0.052%) was used as the electrolyte for an electrolytic cell in which tin plate was the cathode and stainless steel the anode. Twelve volts and ten amps were applied to the solution for five seconds at 70° F. and a pH of 2.5. The silvery colored tin plate was rinsed in D.I. water, dried, and placed in a boiling solution of 6.67 g/l sodium thiosulfate five hydrate, 1.67 g/l sulfuric acid and 1.0 g/l non-ionic wetting agent for two minutes. The exposed tin surface showed no sulfide staining. Baking the rest of the exposed tin surface at 420° F. for one hour showed no yellow stains due to tin oxide formation.

EXAMPLE 14

A solution of 5.0 g/l potassium sulfate twelve hydrate ($KCr(SO_4)_2 \cdot 12H_2O$) which contains about 0.52 grams of chromium (0.052%) was used as the electrolyte for an electrolytic cell in which tin plate was the cathode and stainless steel the anode. Twelve volts and ten amps were applied to the solution for five seconds at 70° F. and a pH of 2.25. The silvery colored tin plate was rinsed in D.I. water, dried, and placed in a boiling solution of 6.67 g/l sodium thiosulfate five hydrate, 1.67 g/l sulfuric acid and 1.0 g/l non-ionic wetting agent for two minutes. The exposed tin surface showed a lack of sulfide staining even on the side of the tin plate not facing the anode. Baking the rest of the exposed tin surface at 420° F. for one hour showed no yellow stains due to tin oxide formation.

EXAMPLE 15

A solution of 5.0 g/l potassium chromium sulfate twelve hydrate ($KCr(SO_4)_2 \cdot 12H_2O$) which contains about 0.52 grams of chromium (0.052%) was used as the electrolyte for an electrolytic cell in which tin plate was the cathode and stainless steel the anode. Twelve volts and ten amps were applied to the solution for five seconds at 70° F. and a pH of 2.0. The silvery colored tin plate was rinsed in D.I. water, dried, and placed in a boiling solution of 6.67 g/l sodium thiosulfate five hydrate, 1.67 g/l sulfuric acid and 1.0 g/l non-ionic wetting agent for two minutes. The exposed tin surface showed very slight sulfide stains. Baking the rest of the exposed tin surface at 420° F. for one hour showed very light yellow stains due to tin oxide formation.

EXAMPLE 16

A solution of 5.0 g/l potassium chromium sulfate twelve hydrate ($KCr(SO_4)_2 \cdot 12H_2O$), which contains about 0.52 grams of chromium (0.052%) was used as the electrolyte for an electrolytic cell in which tin plate was the cathode and stainless steel the anode. Twelve volts and ten amps were applied to the solution for five seconds at 70° F. and a pH of 2.4. The silvery colored tin plate was rinsed in D.I. water, dried, and placed in a boiling solution of 6.67 g/l sodium thiosulfate five hydrate, 1.67 g/l sulfuric acid and 1.0 g/l non-ionic wetting agent for two minutes. The exposed tin surface showed no sulfide staining and minor sulfide on the side not exposed to the anode. Baking the rest of the tin surface at 420° F. for one hour showed no yellow stains, on either side of the tin plate, due to tin oxide formation.

EXAMPLE 17

A solution of 5.0 g/l chromium citrate was used as the electrolyte for an electrolytic cell in which tin plate was the cathode and stainless steel the anode. Twelve volts and ten amps were applied to the solution for five seconds at 70° F. and a pH of 2.3. The silvery colored tin plate was rinsed in D.I. water, dried, and placed in a boiling solution of 6.67 g/l sodium thiosulfate five hydrate, 1.67 g/l sulfuric acid and 1.0 g/l non-ionic wetting agent for two minutes. The exposed tin surface showed extensive sulfide staining. Baking the rest of the exposed tin surface at 420° F. for one hour showed extensive yellow stains due to tin oxide formation. Citric acid is known to form a protective film over tin plate.

EXAMPLE 18

A solution of 5.0 g/l potassium chromium sulfate twelve hydrate ($KCr(SO_4)_2 \cdot 12H_2O$), to which 100 mg/l of sulfite ($SO_3^{-2}$) was added to prevent the formation of hexavalent chromium, was used as the electrolyte for an electrolytic cell in which tin plate was the cathode and stainless steel the anode. Twelve volts and ten amps were applied to the solution for five seconds at 70° F. and a pH of 2.3. The silvery colored tin plate was rinsed in D.I. water, dried, and placed in a boiling solution of 6.67 g/l sodium thiosulfate five hydrate, 1.67 g/l sulfuric acid and 1.0 g/l non-ionic wetting agent for two minutes. The exposed tin surface showed no sulfide staining. Baking the rest of the exposed tin surface at 420° F. for one hour showed no yellow stains due to tin oxide formation.

EXAMPLE 19

A solution of 5.0 g/l potassium chromium sulfate twelve hydrate ($KCr(SO_4)_2 \cdot 12H_2O$), to which 500 mg/l of potassium dichromate was added, was used as the electrolyte for an electrolytic cell in which tin plate was the cathode and stainless steel the anode. Twelve volts and ten amps were applied to the solution for five seconds at 70° F. and a pH of 2.3. The silvery colored tin plate was rinsed in D.I. water, dried, and placed in a boiling solution of 6.67 g/l sodium thiosulfate five hydrate, 1.67 g/l sulfuric acid and 1.0 g/l non-ionic wetting agent for two minutes. The exposed tin surface showed no sulfide staining. Baking the rest of the exposed tin surface at 420° F. for one hour showed no yellow stains due to tin oxide formation.

EXAMPLE 20

A solution of 5.0 g/l potassium chromium sulfate twelve hydrate ($KCr(SO_4)_2 \cdot 12H_2O$), to which 500 mg/l of a non-ionic wetting agent was added, was used as the electrolyte for an electrolytic cell in which tin plate was the cathode and stainless steel the anode. Twelve volts and ten amps were applied to the solution for five seconds at 70° F. and a pH of 2.3. The silvery colored tin plate was rinsed in D.I. water, dried, and placed in a boiling solution of 6.67 g/l sodium thiosulfate five hydrate, 1.67 g/l sulfuric acid and 1.0 g/l non-ionic wetting agent for two minutes. The exposed tin surface showed no sulfide staining. Baking the rest of the exposed in tin surface at 420° F. for one hour showed no yellow stains due to tin oxide formation.

EXAMPLE 21

A solution of 5.0 g/l potassium chromium sulfate twelve hydrate ($KCr(SO_4)_2 \cdot 12H_2O$) which contains about 0.52 grams of chromium (0.052%) was used as the electrolyte for an electrolytic cell in which tin plate was the cathode and stainless steel the anode. Twelve volts and ten amps were applied to the solution for five seconds at 70° F. and a pH of 2.3 maintained by use of a Potassium hydrogen phthalate sulfuric acid buffer system. The tin plate was rinsed in D.I. water, dried, and placed in a boiling solution of 6.67 g/l sodium thiosulfate five hydrate, 1.67 g/l sulfuric acid and 1.0 g/l non-ionic wetting agent for two minutes. The exposed tin surface showed no sulfide staining. Baking the rest of the exposed tin surface at 420° F. for one hour showed no yellowing due to tin oxide formation.

What is claimed is:

1. A method of electrocating a tin or tin plated article with a non-hexavalent trivalent chromium oxide and/or trivalent chromium hydroxide protective coating comprising:

cleaning the tin or tin plated article, making the cleaned article a cathode of an electrolytic cell having a dilute sodium carbonate solution to provide a clean reactive surface tin or tin plated article, rinsing the clean reactive surface tin or tin plated article, placing the rinsed clean reactive surface tin or tin plated article as a cathode in an electrolytic trivalent chromium electrolyte which is a trivalent chromium composition free of chromium complexing agents and said trivalent chromium composition having a pH of about 2.25 to about 2.40 and comprises a trivalent chromium compound selected from the group consisting of potassium chromium sulfate, chromium sulfate chromium chloride and hydrates thereof; and applying electrical current to the cathode for about 2 to 10 seconds to provide a trivalent chromium oxide and/or hydroxide protective coated tin or tin plated article.

2. A method for electrocoating a tin or tin plated article with a non-hexavalent trivalent chromium oxide and/or trivalent chromium hydroxide protective coating comprising:

cleaning the tin or tin plated article to provide a clean tin or tin plated article, placing said clean tin or tin plated article as a cathode in an electrolytic trivalent chromium electrolyte which is a trivalent chromium composition free of chromium complexing agents and having a pH of about 2.0 to about 3.0; and applying electrical current to the cathode to provide a trivalent chromium oxide and/or hydroxide protective coated tin or tin plated article.

3. The method of claim 2 wherein the pH range is about 2.25 to about 2.40.

4. The method of claim 3 wherein said trivalent chromium composition comprises trivalent chromium compounds selected from the group consisting of potassium chromium sulfate, trivalent chromium chloride, trivalent chromium sulfate and the hydrates thereof.

5. The method of claim wherein the article is exposed to the trivalent chromium composition for up to 30 seconds.

6. The method of claim 5 wherein the tin or tin plated article is exposed to the trivalent chromium composition for about 2 to 5 seconds.

7. The method of claim 2 wherein the pH is about 2.0 to about 2.4; and applying electrical current to the cathode for up to 30 seconds to provide said trivalent chromium oxide and/or hydroxide protective coated tin or tin plated article.

8. The process claimed in claim 7 wherein the concentration of chromium (III) is maintained above 0.05 grams per liter of solution.

9. The process as claimed in claim 8 wherein said chromium (III) is a chromium salt selected from the group consisting of potassium chromium sulfate, a chromium sulfate, a chromium chloride, and hydrates thereof.

* * * * *